United States Patent [19]

Kozon

[11] Patent Number: 4,821,375

[45] Date of Patent: Apr. 18, 1989

[54] RECESSING HINGE MECHANISM

[75] Inventor: Anthony R. Kozon, Burbank, Ill.

[73] Assignee: Viking Metal Cabinet Co., Inc., Chicago, Ill.

[21] Appl. No.: 150,059

[22] Filed: Jan. 29, 1988

[51] Int. Cl.[4] ..... A47B 88/00

[52] U.S. Cl. ..... 16/360; 16/368; 16/370; 312/331

[58] Field of Search ..... 16/358, 360, 361, 364, 16/368, 370; 49/254–259, 346; 312/331, 334, 322

[56] References Cited

U.S. PATENT DOCUMENTS

| | | | |
|---|---|---|---|
| 632,607 | 9/1899 | Wernicke | 312/331 |
| 1,124,570 | 1/1915 | Woltz | 312/331 |
| 3,456,995 | 7/1969 | Nyquist | 312/331 |

FOREIGN PATENT DOCUMENTS

| | | | |
|---|---|---|---|
| 69163 | 10/1958 | France | 312/322 |
| 428072 | 3/1975 | U.S.S.R. | 49/259 |

*Primary Examiner*—Nicholas P. Godici
*Assistant Examiner*—Edward A. Brown
*Attorney, Agent, or Firm*—Andrew F. Zikas

[57] ABSTRACT

An improved recessing hinge mechanism for doors and the like is comprised of an anchor member slidably supporting an upper end of an arm of a selectively expandable stabilizer device having two cooperative arms pivotably joined to one another at their respective midpoints and pivotably supporting a lower end of the opposite arm, with the ends of the respective arms, opposite those attached to the anchor member, being slidably/pivotably attached to a support/pivot rod, which pivotably carries the pivot edges of a door. For a recessing operation, the door is pivoted about the rod from a closed position to an open position, parallel to the expanded stabilizer device and then linearly moved toward the anchor member, with the scissors-like stabilizer device closing to a minimum dimension so that the support rod stops adjacent to the anchor member. The inventive hinge mechanism provides a ratio of recess depth to door width which is greater than about 1:0.95.

15 Claims, 4 Drawing Sheets

RECESSING HINGE MECHANISM

BACKGROUND OF THE INVENTION

1. Field Of The Invention

The invention relates to hinge mechanisms and somewhat more particularly to improved recessing hinge mechanisms for doors and like movable barriers.

2. The Prior Art

Hinge mechanisms including recessing hinge mechanisms for doors and the like are known. However, prior art hinge mechanisms or systems have numerous disadvantages and drawbacks. Among the various disadvantages are excessive space requirements, particularly recessing depth requirements, relatively complex mechanisms to accommodate pivotable and recessable door movements, substantial tendency to malfunction during the recessing/pivoting operations, lack of relatively easy adjustability for smooth operation, lack of cosmetic compatibility with cabinet and other enclosure walls, and lack of economy.

One particular type of recessing hinge mechanism or system comprises a drawer-type slide system with tracks anchored parallel to a cabinet or other enclosure wall and parallel to a door in a recessed position. Slides are provided near each end of the door and hinges are suitably fastened to the carriage section of each slide for movement along the tracks. The hinges are also fastened to end edges of a door for pivoting the door across the door opening and, when opened, for recessing into the enclosure, parallel to the cabinet wall.

The foregoing prior art recessing hinge system is disadvantageous for a variety of reasons, including that the door recess depth is reduced by the length of the slide carriage, typically about 3 to 5 inches (about 8 to 13 cm). Further, door recess depth is also reduced by limited lengths of slide mechanisms available, generally in about 2 inch (about 5 cm) increments, which can reduce recess depth up to an additional 2 inches (5 cm). Yet further, installation of these systems requires a follower mechanism fastened rigidly to each slide carriage to prevent a door from going into a cant position. Additionally such follower mechanisms are cost detrimental. Further, adjustments for cabinet to door cosmetics with these types of recessing hinge systems are relatively difficult.

Another type of recessing door hinge system comprises a follower mechanism attached to an expandable scissors-like device. The scissors-like device is fastened at one end to an anchor member located at the rear of the cabinet wall and at the other end to a follower. The follower mechanism is attached to hinges, which join with and pivot the door. When the door is pivoted to its open position, recessing occurs with the scissors-like device contracting toward the rear of the cabinet wall.

The foregoing hinge system is disadvantageous for a variety of reasons, including that the door recess depth is reduced by the follower mechanism, typically about 3 to 6 inches (about 8 to 15 cm) or more. Further, the follower mechanisms are an additional item which must be guided, usually in cooperative tracks and the like, and are cost detrimental. Yet further, adjustments for operational ease are difficult and cabinet to door cosmetics are relatively unattractive because of installation/adjustment difficulties.

Yet another type of recessing hinge mechanism or system comprises a follower mechanism attached via hinges to a door (with no scissors-like device). However, this type of system is also disadvantageous in that the door recess depth is reduced by the dimension of the follower mechanism, typically about 3 to 6 inches (about 8 to 15 cm). Further, this system does not lend itself to ease of operation and tends to malfunction and jam during usage.

SUMMARY OF THE INVENTION

The invention provides improved recessing hinge mechanisms for doors and like movable barriers. The recessing door hinge mechanisms of the invention are especially adapted for use with enclosable storage spaces, such as cabinets and like devices.

The recessing hinge mechanisms of the invention substantially eliminate most of the drawbacks associated with prior art recessing hinge mechanisms. By utilizing the inventive recessing hinge mechanisms, one is able to obtain a recess depth to door width ratio which is greater than about 1:0.95 and preferably is in the range of about 1:0.95 to about 1:0.995. Thus, substantially no space loss occurs at the rear of the cabinet or recess space due to mechanism interference, such as for follower bars, stabilizers, stops, adjustment fixtures, etc. The inventive recessing hinge mechanisms are simple in construction and operation, relatively economical to manufacture, facilitate expeditious adjustments for easy, smooth and highly reliable operation and provides aesthetic cabinet-to-door cosmetics.

The inventive recessing hinge mechanisms for doors and like movable barriers include an elongated anchor member having opposing ends and being attachable to a support means, with a scissors-like stabilizer device having two cooperative arms pivotably joined to one another about their respective midpoints, having an upper end of one of such arms slidably/pivotably attached to the anchor member and the lower end of the other of such arms being selectively slidable and freely pivotably attached to the anchor member, and an elongated support rod being pivotably/slidably attached to opposing ends of each of the arms, opposite the ends thereof attached to the anchor member. A door or the like can be pivotably supported or carried on opposing ends of the support rod. Door guide means can be provided along upper and lower edges of a wall defining a recess space, with the anchor member being attached to a rear edge of the wall so that during a recessing operation, the terminal ends of the support rod, which are attached to the door, are guided parallel to the plane of the wall, to a position closely adjacent to the anchor member.

The recessing hinge mechanisms of the invention function equally well with either a right-hand hinged or left-hand hinged vertically mounted door as well as with horizontally mounted doors (sometimes referred to as flip-up or flipper doors). On horizontally mounted doors, a recessing hinge mechanism or system of the invention can be used for a flip-up movement to the horizontal plane and recessed or a flip-down movement to the horizontal plane and recessed. The inventive recessing hinge mechanism may be mounted at substantially any angle with good recessing results. The recess depth to door width ratio is equally good at substantially any mounting angle. Gravitational pull on doors may provide a somewhat different feet or effect at various mounting angles but will not detract from proper recessing and hinging operations. Doors provided with the inventive recessing hinge mechanisms can be pivoted open to a recessing position and readily recessed, floating smoothly, jam-free entirely to the rear of a cabinet or recess space, with substantially no space loss at the rear for mechanism interference, such as for follower bars for mounting of hinges, stabilizers, stops, adjustment fixtures, etc. This provides a substantially improved ratio of recess depth to door width. For example, a 29⅝ inch (about 75 cm) wide door can be totally recessed into a 30 inch (about 76 cm) O.D. deep cabinet. Thus, cabinets can be manufactured wider or doors can be recessed more to entirely eliminate or substantially decrease front protrusion. The recessing hinge mechanisms of the invention provides much more flexible latitudes as to size and/or installations suitable for use with recessing doors.

A number of advantages are apparent with the use of the inventive recessing hinge mechanisms. For example, adjustment of doors for proper operation and door to cabinet cosmetics is fast, positive and accurate. In use, door operation is positive with a smooth, non-binding gliding action.

The recessing hinge mechanisms of the invention can have an opposing upper end of one arm and an opposing lower end of the other arm of the stabilizer device, opposite the arm ends attached to the anchor member, attached to the support rod for linear movement along the longitudinal or linear direction of the support rod and for perpendicularly pivotable movement about the axis of the support rod. Weight-bearing means, such as collars, can be fixably mounted at select locations on the support rod to transfer the door weight from the support rod to the anchor member. The anchor member, which preferably is positioned or located at the rear of the recess space with which the inventive recessing hinge mechanisms are associated, can include a first elongated slot extending along the longitudinal direction of the anchor member and a second relatively short slot extending substantially perpendicular to the first slot. The first slot accommodates the horizontal expansion (and contraction) as well as the vertical shortening (and lengthening) of the scissors-like stabilizer device as the door is pulled out of (or pushed in) the recess space. The second slot allows for door adjustments to accommodate door cant.

A slidable pivot mounting means can be attached between an end of each of the arms of the stabilizer device and the support rod, with a first portion of such mounting means being pivotably attached to the end of each respective arm and a second portion being slidably attached to the support rod.

Pivot-receiving apertures can be provided at opposing pivot ends of a door means for pivotably receiving respective ends of the support rod. Guide means can be provided along upper and lower edges of a wall defining the recess space associated with the inventive hinge mechanisms, for receiving respective terminal ends of the support rod, protruding beyond the periphery of the door and for guiding such door parallel to the wall during recessing operations. Nylon buttons or like glide means may be cooperatively associated with tracks affiliated with the guide means for smoothly and properly guiding the door in and out of the recess space. Selectively positionable weight-bearing means may be fixably attached to respective upper, lower and mid-lower areas of the support rod, abutting onto the innermost pivot-receiving apertures of the door and at a lower arm end of the stabilizer device so as to support the door on such rod and transfer the door weight onto the stabilizer device (and anchor member) and thereby allow the terminal ends of the rod to "float" or weightlessly ride in a guide channel during door movement in and out of the recess space.

Further and additional objects, features and advantages of the present invention will be apparent from the following description and claims, and are illustrated in the accompanying drawings, which, by way of illustration, show certain preferred embodiments of the invention and the principles thereof, along with what is now considered to be the best mode contemplated for applying these principles. Other embodiments of the present invention embodying the same or equivalent principles may be used and structural changes may be made as desired by those skilled in the art without departing from the scope and spirit of the invention and falling within the purview of the appended claims.

DESCRIPTION OF PREFERRED EMBODIMENTS

Figure 1:
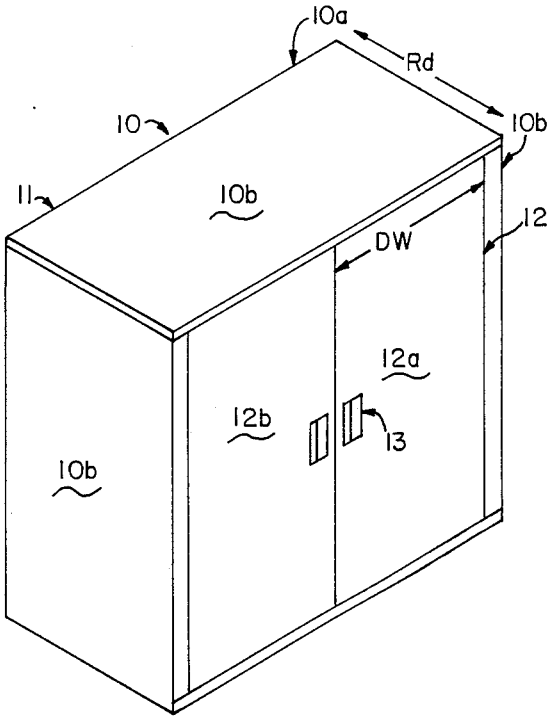
FIG. 1 is an elevated, front prospective view of a closed cabinet structure associable with the recessing hinge mechanism of the invention.

In the drawings, like reference numerals throughout the various Figures refer to like elements.

Referring now to the drawings in some detail, there is shown an enclosed space 10, such as a more or less standard closed-door cabinet 11, preferably manufactured from sheet metal or cold rolled steel, for example, 20 gauge in thickness. Of course, thicker or thinner steel may be utilized and/or the cabinet may be manufactured from wood or other suitable material.

The enclosed space 10 includes a defined recess depth Rd, defined by a rear wall 10*a* suitably joined, as by welding or the like, to a top, a bottom and side walls 10*b* with a front opening 10*c* closable by a door means 12. The door means 12 may include a right-hand hinged door panel 12*a* and a left-hand hinged door panel 12*b*, each having a door width dimension Dw. A suitable security means 13, such as a lockable handle may be provided for securing the enclosed space 10 when the respective door panels are in the closed position, as shown. A recessing hinge mechanism (not shown here but best seen in FIGS. 3 and 10) operationally interconnects the enclosed space 10 with the door means 12 so that the door means in a closed position can extend across the front opening and in an opened position can be recessed into the recess depth Rd.

Figure 2:
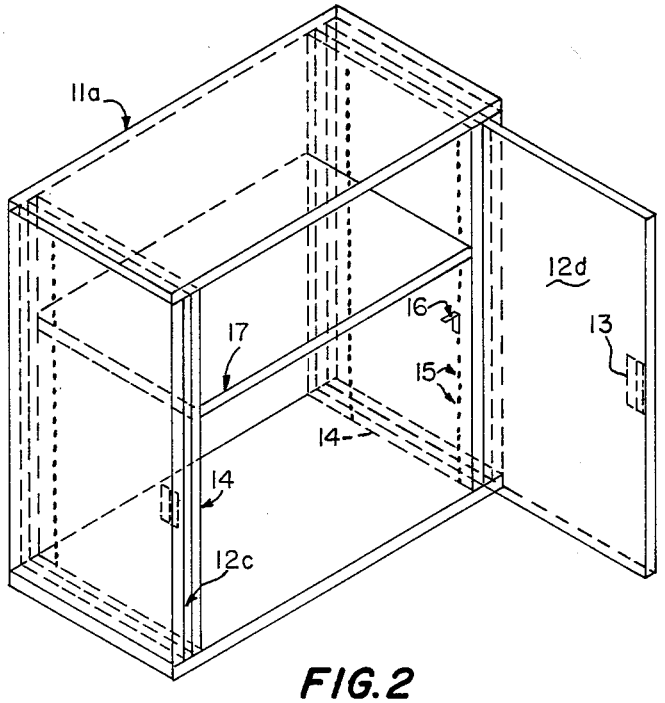
FIG. 2 is a somewhat similar view, with portions in phantom and portions exploded, of an opened cabinet structure associable with the recessing hinge mechanism of the invention, with one door in a recessed position and another door in an extended position.

FIG. 2 illustrates another cabinet structure 11*a* associable with the recessing hinge mechanisms of the invention. This cabinet structure is illustrated with an opened and extended or unrecessed door panel 12*d* and, in phantom, an opened and recessed door panel 12*c*. Further, cabinet structure 11*a* includes an inner panel or wall 14 provided with means for supporting one or more shelves 17 and protecting the recessing hinge mechanism (not shown) from environmental contamination and unauthorized tampering. The inner wall 14 may be provided with a series of adjustment recesses 15 at select intervals, say in about ½ inch (about 1.2 cm) increments for receiving shelf-support means 16, such as pegs, clips or protruding knock-outs, supporting lateral edges of each respective shelf 17.

Figure 4:
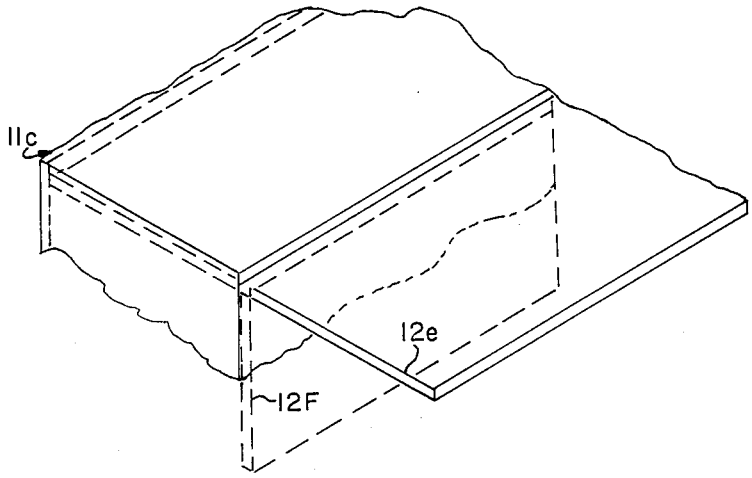
FIG. 4 is a partial, elevated and somewhat prospective view, with portions in phantom, of an opened cabinet structure associable with the recessing hinge mechanism of the invention.

Yet another cabinet structure 11*c* is shown at FIG. 4 which may be operationally associable with recessing hinge mechanisms of the invention. Cabinet structure 11*c* may be substantially identical in construction to cabinet structures 11*a* or 11*b*, except that the door panel 12*e* is horizontally hinged so as to be capable of flipping-up to the horizontal plane for recessing into a recess depth or space defined by the upper wall or top of cabinet 11*c*.

Figure 3:
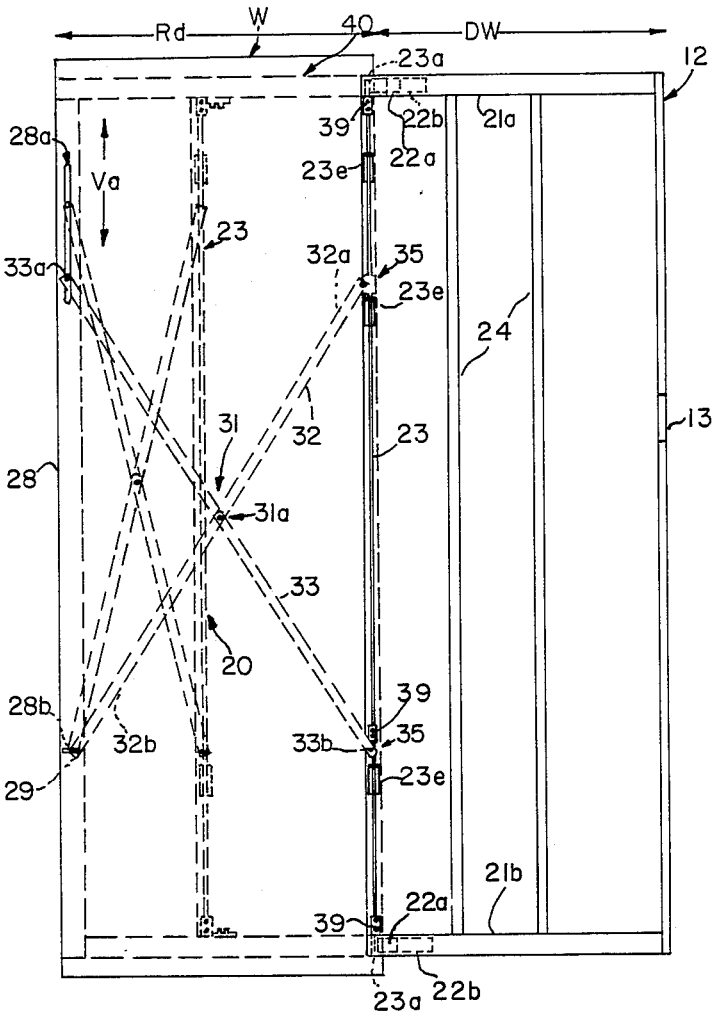
FIG. 3 is an elevated, somewhat prospective view, partially in phantom, of an embodiment of the recessing hinge mechanism of the invention in cooperative association with a recess space and a door, and illustrating various operational positions of such recessing hinge mechanism.
Figure 10:
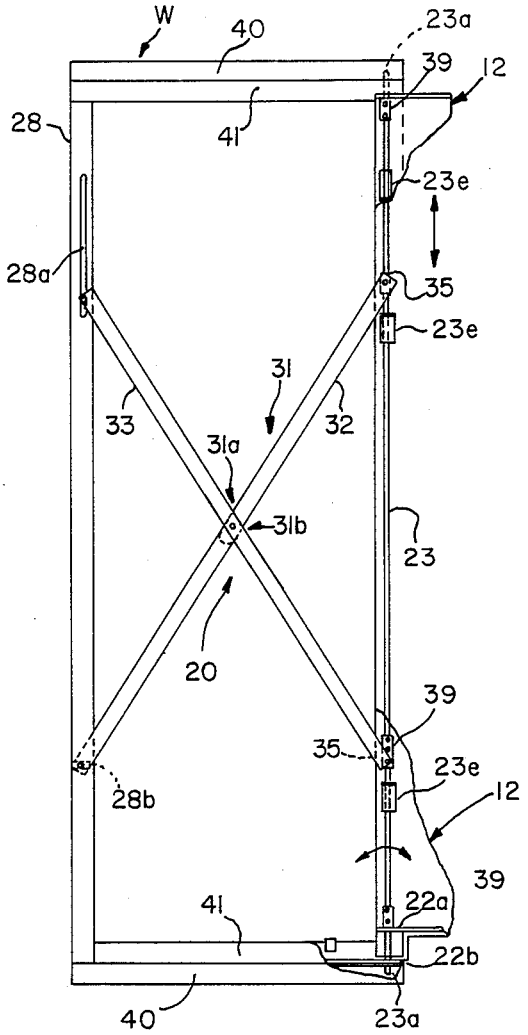
FIG. 10 is a partial, elevated and somewhat prospective view of an embodiment of the recessing hinge mechanism of the invention in association with a wall defining a recess space and a door recessable thereinto.

Referring now particularly to FIGS. 3 and 10, a recessing hinge mechanism or system 20 of the invention is illustrated in various operative positions in cooperation with a door means 12 and a wall W defining a recess space or depth Rd.

The door means 12 has a width dimension Dw and may include upper and lower return flange means 21*a* and 21*b* respectively. Each of the flange means 21*a*, 21*b* may be provided with innermost and outermost pivot-receiving apertures 22*a* and 22*b* respectively. If desired a single return lip or the like may be utilized with a single pivot receiving aperture. A support rod 23 longitudinally extends the length of the door and ends thereof are mounted for pivotable movement within apertures 22*a*, 22*b* respectively, with the respective terminal ends 23*a* of rod 23 extending beyond the upper and lower periphery of door means 12. In an exemplary embodiment, the rod may be formed of cold-rolled steel having a diameter of about ¼ inch (about 0.6 cm) in association with a standard 24⅞ inch wide by 36 inch high (about 63 by 91 cm) door. Of course with larger or smaller (i.e., heavier or lighter) doors, a different diameter rod may be utilized. Door means 12 may also include reinforcement caps or ribs 24 or the like to provide added rigidity and strength to the door structure.

An elongated anchor member 28 is suitably attached at the rear of the wall W, as to a support means (not shown). The anchor member 28 may be provided with a first slot 28*a* extending along the longitudinal direction of the anchor member and a second slot 28*b* extending substantially perpendicular to the first slot 28*a*. The first slot 28*a* accommodates horizontal expansion (and contraction) and vertical shortening (and lengthening) of a scissors-like stabilizer device 31 as the door means 12 is pulled out of or pushed into the recess space or depth Rd. The second slot 28*b* allows adjustment for door cant during assembly.

Figure 3A:
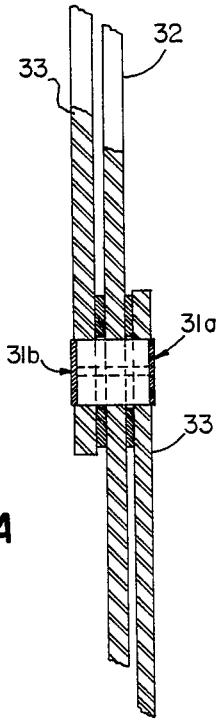
FIG. 3*a* is a partial, elevated cross-sectional view of a preferred interconnection between cooperative arms of the stabilizer device utilized in the practice of the invention.

The scissors-like stabilizer device 31 comprises two cooperative arm members 32 and 33 pivotably joined to one another about their respective midpoint 31*a* and being arranged so that in a closed position, the arms are substantially superimposed relative one to another, as shown in FIG. 3*a*. In an exemplary embodiment, the stabilizer device may be formed of ⅛ inch thick (about 0.32 cm) by 1 inch (about 2.5 cm) wide cold rolled steel stock, sometimes referred to as flat wire, band wire or strip stock. In a preferred embodiment, (FIG. 3*a*) one of the arm members, for example arm member 33, is split in half and jointed as a unitary assembly via a pivot means 31*b*, such as a fixed fastening means, for example a suitable rivet-washer combination, extending through the midpoint 31*a* of the other arm member 32. This split arrangement allows the stabilizer device 31 to close to a minimum dimension (i.e., the width of one arm member when the arms are in a closed or superimposed position) and reduce any space loss at the rear of the recess space.

Figure 9:
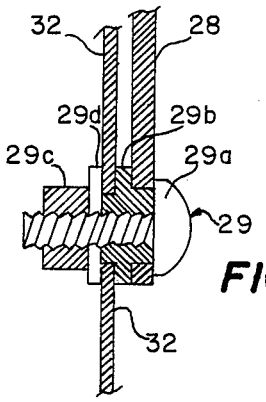
FIG. 9 is a partial, cross-sectional view of the interconnection shown at FIG. 8.

The lower arm 32*b* of arm 32 is pivotably attached via a non-binding fastening means 29 (best seen at FIG. 9) to the anchor member 28 at slot 28*b* thereof. The upper end 33*a* of arm 33 is pivotably and slidably attached via a suitable fastening means to the anchor member 28 at the slot 28*a* thereof. Thus, in the embodiment shown, upper end 33*a* slidably moves up and down within the slot 28*a* while the arm 33 pivots about the fastening means while the lower end 33*b* substantially only pivots about its fastening means. Of course, if desired, these relations can be reversed. The opposing ends 32*a*, 33*b* of arm members 32 and 33 are slidably/-pivotably attached to the support rod 23. The opposing ends 32*a* 33*b* of the arms 32, 33 (opposite the ends 32*b*, 33*a* attached to the anchor member 28) are so attached as to be capable of linear slidable movement along the longitudinal direction of support rod 23 and perpendicularly pivotable movement about the axis of the support rod.

Figure 5:
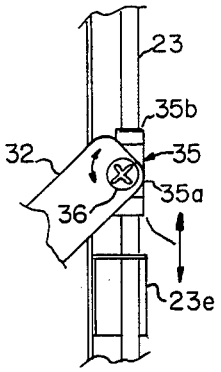
FIG. 5 is a partial, elevated and somewhat prospective close-up view of a slidable pivot mounting means between portions of the inventive mechanism.
Figure 6:
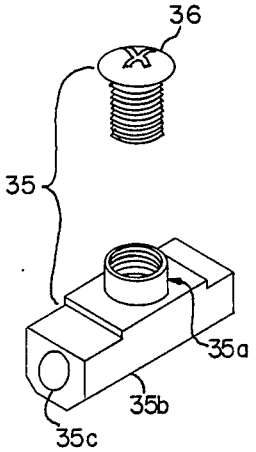
FIG. 6 is an exploded prospective view of an embodiment of the mounting means shown at FIG. 5.

As best seen in FIGS. 5 and 6, a slidable pivot mounting means 35 is provided at the attachment point between the respective end of the arms 33, 32 and the support rod 23. The slidable pivot mounting means 35 may comprise a somewhat squat T-shaped body with a first portion 35*a* for pivotable attachment to an arm end and a second portion 35*b* for slidable attachment to the support rod 23. The first portion 35*a* may comprise the leg of the T-shaped body and may include an upstanding boss or the like for accommodating the material thickness of an associated arm, with a threaded interior for receiving the thread of a screw 36. A washer (not shown) may be provided between the bottom of the screw head and the top of the boss to facilitate pivotable movement of an arm therebetween. The second portion 35*b*, which is the cross-member of the T-shaped body, includes an axial through-bore 35*c* extending the length thereof for readily accommodating the diameter of the support rod. The through-bore 35*e* allows the attached arms 32, 33 to easily slide or linearly travel up and down the support rod 23 as the stabilizer device 31 expands and/or contracts during recessing operations.

Weight-bearing means 39, such as weight-bearing collars having set-screws for fixably mounting the weight-bearing collars in a select position, can be provided on the support rod 23 adjacent the innermost pivot apertures 22*a* of a door, as well as at a mid-lower area of the rod 23, above the juncture point of lower arm end 33*b* and rod 23. In preferred embodiments, two stop means (which may be non-weight-bearing means) are fixably mounted on the support rod 23 at select positions respectively above and below each slidable pivot mounting means. Preferably, the lower slidable pivot mounting means is provided with two relatively closely adjacent stop means so that such mounting means has very limited, if any, linear movement, while the upper slidable pivot mounting means is provided with two spaced-apart stop means so as to allow a somewhat extended amount of linear movement or travel. Rod stabilizer brackets 23*e* (best seen at FIG. 5) may be provided along the length of the rod and secured, as by welding or the like to the inner wall of the door and may comprise non-weight bearing means utilized as one or more stop means.

The weight-bearing means are positioned near the respective upper and lower ends of support rod 23, adjacent the innermost pivot apertures 22*a* on door means 12 as well as at a mid-lower area of rod 23. These weight-bearing means may comprise weight-bearing bands or annular rings with suitable set screws allowing the weight of the door means to be transferred via the rod to the stabilizer device 31 and ultimately to the anchor member 28 and its support means. In this manner substantially no weight is transferred to the bottom of the door and the entire door floats weightlessly within the guide means.

Figure 7:
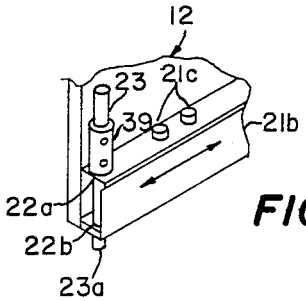
FIG. 7 is a partial, elevated and somewhat prospective view of a lower adjustment bracket for positioning a door for operational and cosmetic purposes in accordance with the principles of the invention.

Referring now to FIG. 7, a lower portion of door means 12 is shown having support rod 23 pivotably mounted through apertures 22*a* and 22*b*. Aperture 22*a* comprises the innermost pivot aperture. Provided on the return lip of flange 22*b* is an upper laterally slidable bracket plate or the like positionable by set screws 21*c*, allowing for adjustment of the door position for operational and cosmetic purposes. A similiar bracket plate may be provided along the upper portion of the door means.

Figure 11:
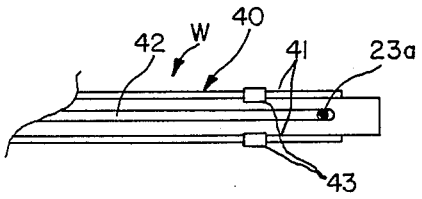
FIG. 11 is a partial, top and somewhat prospective view of a guide means utilized in the practice of the invention.

Referring now to FIG. 11 wherein certain details of the interconnection between a wall W and the support rod 23 are illustrated, in conjunction with a guide means 40 utilized to steer a door means during recessing operations. The outer top and outer bottom edges of a wall defining a recess space may be substantially identical in configuration and generally comprise a somewhat U-shaped cross-sectional portion, with a central guide slot or channel extending along the bottom of the U-shaped portion. As shown, the upstanding legs or flanges 41, 41 are parallel to one another with an outermost of such legs forming an outer lip at the upper and lower portions of the cabinet. Between the legs 41, 41 an extended center slot 42 is provided for receiving and guiding ends 23*a* of the support rod 23. Nylon or the like guide buttons or rollers 43 may be provided at the forward edges of the legs 41, above the slot 42 to aid in centering door side walls within the track defined by such legs. With this type of arrangement, a door means is readily moved parallel to sides of a wall without binding or jamming.

With the inventive recessing hinge mechanism or system, doors and like movable barriers are readily pivoted open to a recessing position and easily recessed, floating smoothly and jam-free, entirely to the rear of a recess space, such as in a cabinet, with substantially no space loss. Further, the inventive mechanisms allow quick, accurate and positive adjustments for proper door operation and for aesthetic door-to-cabinet cosmetics. The door weight does not bind on the pivot points but is transferred directly to the anchor member through the combination of the support rod, weight-bearing collars and scissors-like stabilizer device. The respective upper ends of the cooperative arms of the stabilizer device move pivotably and linearly while the respective lower ends of the cooperative arms primarily pivot, with the end attached to the support rod having some minor linear movement.

Figure 8:
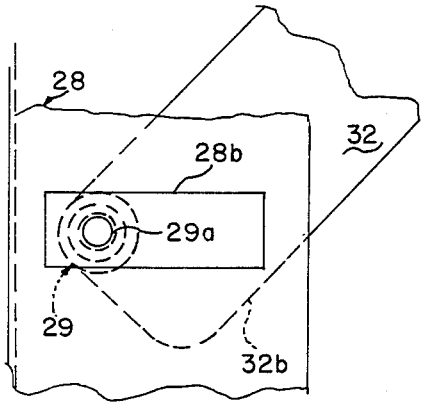
FIG. 8 is a somewhat similar view to that of FIG. 7 illustrating a lower interconnection between an anchor member and an arm end of the recessing hinge mechanism of the invention.

Operative principles of the invention are attained through recessing hinge mechanisms which utilize a support or pivot rod positioned at door edge pivot points (FIGS. 3, 7 and 10) and extend from each door end a sufficient length to slidably engage a guide channel with adjacent guide walls and friction-reducing guide means, such as guide buttons or the like (FIGS. 10 and 11) which cooperate for guiding the door into and out of the recess. The support or pivot rod is held in the operative position by selectively positionable collars or the like, one at the door upper end and one at the door lower end (FIGS. 7 and 10). At the lower door end, a rod position adjustment means or bracket (FIG. 7) may also be provided which transposes the side-to-side alignment (cant) of the door. The rod also carries two substantially identical slidable pivot mounting means or brackets (FIGS. 5 and 6). One such pivot mounting means is located at about a mid-lower area of the rod and has free pivoting privileges but is held in a relatively stationary linear position by a selectively positionable collar or stop means (on a horizontally hinged door, a pair of stop means may be required for proper operation). The other slidable pivot mounting means is located along a mid-upper area of the support rod and also has free pivoting privileges plus substantial linear movement up and down the rod (FIGS. 3, 5 and 10). Perpendicularly hinged to each of the slidable pivot mounting means is an end of a leg of the scissors-like stabilizer device. The other end of each respective leg of the stabilizer device is hinge attached to the anchor member, which is rigidly supported at the rear edge of the wall defining the recess space, adjacent the door recess travel path (FIGS. 3, 8 and 10). An upper leg end of the stabilizer device is hinge fastened to an elongated tangent slot (FIGS. 3 and 10) in the anchor member. This allows the stabilizer device to expand horizontally and shorten vertically as the door is pulled out of the recess space and vice-versa, to contract and shorten as the door is pushed into the recess space. A lower leg of the stabilizer device is hinge fastened to a relatively short perpendicular slot in the anchor member (FIG. 8) by an interlocking pivot device (FIG. 9) that allows for door cant adjustment by selective positioning of the interlocking pivot device. With this arrangement, the door weight is totally transferred to the scissors-like stabilizer device and the anchor member so that the door floats or weightlessly glides or moves without any gravitational drag on the guide means (combined upstanding flanges and recessed slot or channel).

With heavy doors that may not be adaptable to be totally suspension supported, further aid may be provided with a glide washer or the like inserted on the support rod between the door guide means. Extremely heavy doors may be yet further weight support aided with a rolling support on the pivot or support rod.

During operation, doors operationally associated with recessing hinge mechanisms of the invention are pivoted about the support or pivot rod from a closed position to an open position, parallel with an expanded scissors-like stabilizer device which is pivot attached to the door pivot rod at two locations and to an anchor means at two locations at the rear of the cabinet or recess space. The door is supported by a combination of a pivot/support rod and stabilizer device and fixed or stabilized by the stabilizer in the guidance slot and track guided into the recess space. The configuration and operational association of the pivot or support rod and related components allow the stabilizer to properly operate and store itself adjacent the rear of the recess space, thereby allowing the associated door to recede substantially and entirely to the back of the recess space. With this arrangement, a ratio of recess depth to door width which is greater than about 1:0.95 is attained and preferably this ratio ranges from about 1:0.95 to about 1:0.995.

The recessing hinge mechanisms of the invention combine many functions into the pivot or support rod per se: it provides pivot points for a door; it guides the door; it positions a door for pivotable movement; it functions as a structural member for stabilizing and rigidifying a door; it functions as a structural medium for facilitating operation and cosmetic adjustments; it provides structural strength to a door; it functions as an intermediate member for the combination pivot and stabilizer length change; and it provides a good medium to aid in preventing security intrusions into the space enclosed by a door.

What is claimed is:

1. A recessing hinge mechanism for doors and the like, comprising:

an elongated anchor member having opposing ends and being attachable to a support means;

a scissors-like stabilizer device moveable between an expanded open position and a contracted closed position, said device having two cooperative arms pivotably joined to one another about their respective midpoints and being arranged so that in said closed position said arms are substantially superimposed relative one to another, with an upper end of one of said arms and a lower end of the other of said arms being slidably/pivotably attached to said anchor member; and an elongated support rod slidably/pivotably attached to opposing ends of each of said arms, opposite the ends thereof attached to said anchor member for pivotably carrying a door means on opposite ends of said rod.

2. A recessing hinge mechanism as defined in claim 1 wherein at least one of said opposing ends of the arms of the stabilizer device is attached for linearly slidable movement along the longitudinal direction of said support rod and both ends of said arms are attached for perpendiculary pivotable movement about the axis of said support rod.

3. A recessing hinge mechanism as defined in claim 2 wherein weight-bearing means are provided on said support rod to transfer door weight from the support rod to the stabilizer device.

4. A recessing hinge mechanism as defined in claim 1 wherein said anchor member includes a first slot extending along the longitudinal direction of said anchor member and a second slot extending substantially perpendicular to said first slot.

5. A recessing hinge mechanism as defined in claim 1 wherein a slidable pivot mounting means is attached between each of said respective arms of said stabilizer device and said support rod.

6. A recessing hinge mechanism as defined in claim 5 wherein said mounting means includes a first portion for pivotable attachment to said arms and a second portion for slidable attachment to said support rod.

7. A recessing hinge mechanism as defined in claim 6 wherein at least one stop means is fixably mounted on said support rod at a select position adjacent neighboring slidable pivot mounting means to limit the linear movement of said mounting means along said support rod.

8. A recessing hinge mechanism as defined in claim 6 wherein weight-bearing means is mounted on said support rod closely adjacent upper and lower pivot edges of said door means and to a mid-lower portion of said rod adjacent a lower slidable pivot mounting means to transfer door weight from said rod to said stabilizer device.

9. A recessing hinge mechanism as defined in claim 1 wherein said door means includes spaced apertures at opposing ends of said door means for pivotably receiving a respective terminal end of said support rod.

10. A recessing hinge mechanism as defined in claim 1 wherein sad door means includes aperture means at opposing ends of said door means for pivotably receiving a respective terminal end of said support rod and cooperative guide means are positioned along upper and lower edges of a wall defining the recess space associated with said hinge mechanism for receiving said ends of the support rod protruding beyond the upper and lower periphery of the door and for guiding said door substantially parallel to said wall during recessing operations.

11. A recessing hinge mechanism as defined in claim 10 wherein said guide means comprises an elongated channel extending along the upper and lower edges of said wall, with upstanding flanges spaced from said channel a distance sufficient to accommodate the thickness of said wall.

12. In combination with an enclosed space having a rear wall and side walls joined thereto and defining a recess space with a front opening closable by a door means, a recessing hinge mechanism interconnecting said enclosed space with said door means whereby said door in a closed position can extend across said front opening and in an opened position can be recessed into said recess space, the improvement wherein said recessing hinge mechanism comprises:

an elongated anchor member having opposing ends and being secured at the rear of said recess space;

a scissors-like stabilizer device moveable between an expanded open position and a contracted closed position, said device having two cooperative arms pivotably joined to one another along their respective midpoints and being arranged so that in said closed position said arms are substantially superimposed relative one to another, with an upper end of one of said arms and a lower end of the other of said arms being pivotable/slidably attached to said anchor member;

an elongated support rod pivotably mounted in apertures located at pivot edges of said door means; and a slidable pivot mounting means attached to opposing ends of each of said arms, opposite the ends thereof attached to said anchor member for pivotable movement about the axis of said support rod and for slidable linear movement along the length of said rod.

13. The combination as defined in claim 12 wherein said recess space has a depth dimension and said door means has a width dimension so as to define a ratio of recess depth to door width which is greater than about 1:0.95.

14. The combination as defined in claim 13 wherein said ratio ranges from about 1:0.95 to about 1:0.995.

15. In combination as defined in claim 12 wherein one of said arms of the stabilizer device is defined by substantially equal upper and lower segments, with an adjacent end of each segment being joined via a pivot means extending through the midpoint of the other of said arms into a unitary assembly, said segments being positioned on opposing sides of said other arm.

* * * * *